US010526820B2

(12) United States Patent
Schroeder et al.

(10) Patent No.: US 10,526,820 B2
(45) Date of Patent: Jan. 7, 2020

(54) HANDLE SYSTEM AND MECHANISM FOR A VEHICLE ROLLING DOOR

(71) Applicant: Transglobal, Inc., Carey, OH (US)

(72) Inventors: Mark A. Schroeder, Findlay, OH (US); Keith E. Dunbar, Warren, OH (US)

(73) Assignee: Transglobal, Inc., Carey, OH (US)

( * ) Notice: Subject to any disclaimer, the term of this patent is extended or adjusted under 35 U.S.C. 154(b) by 499 days.

(21) Appl. No.: 15/414,759

(22) Filed: Jan. 25, 2017

(65) Prior Publication Data

US 2018/0209181 A1 Jul. 26, 2018

(51) Int. Cl.

| | |
|---|---|
| ***E05B 85/10*** | (2014.01) |
| ***E05B 79/06*** | (2014.01) |
| ***E05B 83/04*** | (2014.01) |
| ***E05B 65/00*** | (2006.01) |
| *E05B 79/20* | (2014.01) |

(52) U.S. Cl.

CPC ..... *E05B 79/06* (2013.01); *E05B 65/0021* (2013.01); *E05B 83/04* (2013.01); *E05B 79/20* (2013.01); *E05B 85/10* (2013.01); *Y10T 292/0841* (2015.04); *Y10T 292/0855* (2015.04); *Y10T 292/57* (2015.04)

(58) Field of Classification Search

CPC ..... Y10T 292/0834; Y10T 292/0836; Y10T 292/0841; Y10T 292/0846; Y10T 292/0848; Y10T 292/0849; Y10T 292/0855; Y10T 292/086; Y10T 292/57; Y10T 292/82; Y10S 292/36

See application file for complete search history.

(56) References Cited

U.S. PATENT DOCUMENTS

| | | | | | |
|---|---|---|---|---|---|
| 568,638 | A * | 9/1896 | Sweet | E05B 85/24 | 292/44 |
| 1,777,176 | A * | 9/1930 | McOdy | E05C 9/02 | 292/336 |
| 1,858,804 | A * | 5/1932 | Carlson | E05B 65/0021 | 292/36 |
| 1,909,697 | A * | 5/1933 | Earl | E05B 13/004 | 292/36 |
| 2,048,377 | A * | 7/1936 | Robinson | E05C 9/043 | 70/100 |
| 2,427,909 | A * | 9/1947 | Howell | E05B 65/0021 | 70/216 |
| 2,580,584 | A * | 1/1952 | Nowak | E05B 65/0021 | 292/36 |
| 2,628,117 | A * | 2/1953 | Robinson | E05B 65/0021 | 292/336.3 |
| 3,292,399 | A * | 12/1966 | Charles | E05B 65/0021 | 70/100 |
| 3,683,652 | A * | 8/1972 | Halopoff | E05B 53/003 | 70/467 |

(Continued)

*Primary Examiner* — Carlos Lugo

(74) *Attorney, Agent, or Firm* — Marshall & Melhorn, LLC.

(57) ABSTRACT

A handle system and mechanism for a vehicle rolling door is disclosed. The system has an inside handle with a handle portion and a shank portion. The system also has a selectively rotatable swing plate. The swing plate selectively contacts the shank portion of the inside handle to assist in opening the door. The swing plate can also contact a stop plate. An outside handle is also provided.

12 Claims, 4 Drawing Sheets

(56) References Cited

U.S. PATENT DOCUMENTS

| | | | | | |
|---|---|---|---|---|---|
| 3,953,061 | A * | 4/1976 | Hansen | E05C 9/002 | 292/5 |
| 4,641,865 | A * | 2/1987 | Pastva | E05B 63/0069 | 292/5 |
| 4,966,018 | A * | 10/1990 | Hauber | E05B 5/003 | 70/208 |
| 5,526,660 | A * | 6/1996 | Bennett | E05B 13/004 | 292/336.3 |
| 5,586,458 | A * | 12/1996 | Weinerman | E05B 5/00 | 292/240 |
| 5,595,076 | A * | 1/1997 | Weinerman | E05B 5/00 | 292/34 |
| 6,899,362 | B1 * | 5/2005 | Weinerman | E05B 13/105 | 292/336.3 |
| 7,152,889 | B2 * | 12/2006 | Jeffries | E05B 65/0021 | 292/215 |
| 7,343,762 | B1 * | 3/2008 | East | E05B 13/108 | 292/36 |
| 8,998,275 | B2 * | 4/2015 | Donaldson | E05B 53/00 | 292/198 |

* cited by examiner

HANDLE SYSTEM AND MECHANISM FOR A VEHICLE ROLLING DOOR

FIELD

The field of the device disclosed herein relates to a handle system and mechanism for use with a rolling door, such as for a vehicle.

BACKGROUND

Rolling doors for vehicles are well-known and widely implemented. Typically, they comprise a door, rollers mounted to the door and at least one track in which the rollers move. The doors may also comprise a latch or lock mechanism to lock the door in a closed position. In some cases, an interior door handle is not provided. In these cases, the operator may grasp the lock mechanism to move the door. This may lead to operator injury as the lock is not intended or located to be used as a handle, and it may damage the lock mechanism.

It is also known to include a door handle on a rolling door. Often, these are separate structures from the lock mechanisms. Separate door handles and lock mechanisms also typically require two separate steps to use: first the door has to be unlocked with one hand and then the door has to be raised, often with the other hand. In many cases, the door handle is not ideally positioned: it can be too high, too low or off center from the door. This leads to ergonomics that are not ideal for the worker and which can lead to injury. In addition, a separate handle and lock mechanism requires two separate parts to be manufactured, installed and stocked for repair and replacement.

In view of the disadvantages associated with the prior art designs, it would be advantageous to have a single structure that comprised both a door handle and a lock for a rolling door where the handle was ideally located for operator ergonomics.

SUMMARY

A handle system and handle mechanism for a vehicle rolling door is described. The system has a selectively rotatable inside handle with a handle portion and a shank portion. The shank portion has a first cable aperture, a mounting stud receiving plate and a cable eye with a second cable aperture. A selectively rotatable swing plate having a mounting stud aperture is provided. The aperture preferably has a shape that is complementary to a mounting stud. In one method of operating the system, the swing plate lower edge selectively contacts an intersection of the cable eye and the mounting stud receiving plate. A stop plate is provided with a tab to selectively receive the upper edge of the swing plate. The system also has an outside handle with a handle stud. A mounting stud is located over the handle stud to lock the mounting stud to the handle stud.

BRIEF DESCRIPTION OF THE DRAWINGS

The above, as well as other advantages of the present invention, will become readily apparent to those skilled in the art from the following detailed description when considered in the light of the accompanying drawings in which.

DETAILED DESCRIPTION OF THE PREFERRED EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 1B:
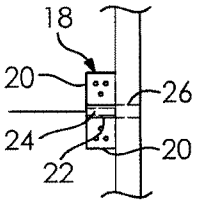
FIG. 1B is a detail from FIG. 1A.
Figure 1C:
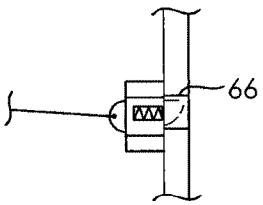
FIG. 1C is a detail from FIG. 1A.
Figure 1A:
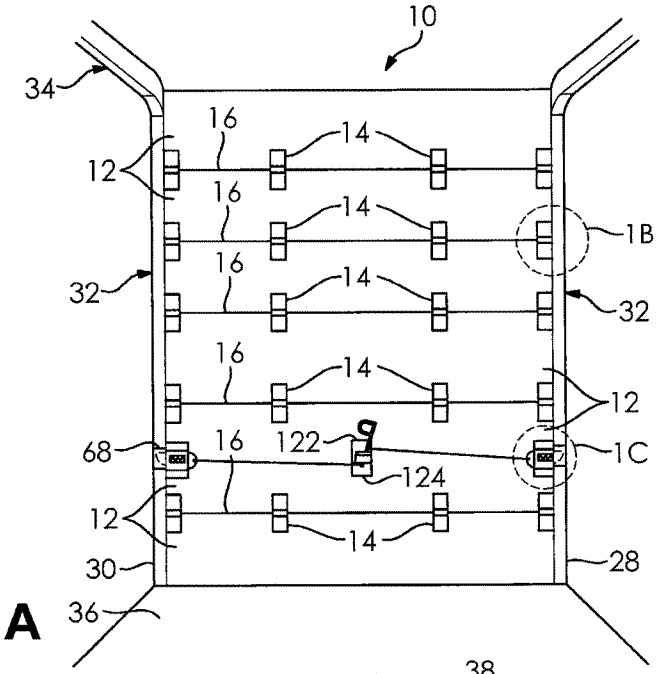
FIG. 1A is one embodiment of a rolling door for a vehicle viewed from inside the vehicle.

Turning to FIG. 1A, one embodiment of a rolling type door 10 for a vehicle (not shown) is depicted. The door 10 is comprised of horizontally oriented panels 12. The panels 12 are connected together through hinges 14 at an intersection 16 of directly adjacent panels 12.

As seen in FIGS. 1A and 1B, at the axial end of each intersection 16, a roller assembly 18 is located. The roller assembly 18 comprises a plate 20 attached to one panel 12 and a plate 20 attached to the adjacent panel 12. A roller shaft housing 22 spans the intersection 16 and houses a roller shaft 24. The plates 20 are hinged about the roller shaft housing 22 so that the panels 12 can move at an angle with respect to one another. At the end of the roller shaft 24, a roller 26 is provided.

As shown in FIG. 1A, roller assemblies 18 are located opposite one another with horizontally matched sets of roller assemblies 18 spaced vertically from one another along the height of the door 10.

The rollers 26 are located in tracks that are mounted to the vehicle. In the depicted embodiment, a first track 28 is mounted to the vehicle on one side of the door 10 and a second track 30 is mounted to the vehicle on the other side of the door 10. Both tracks 28, 30 have a vertical component 32 and a horizontal component 34, which is located at the top end of the vertical component 32.

From FIG. 1A it can be appreciated that the vertical components 32 of the tracks 28, 30 hold the door 10 when the door 10 is in a lowered position. The horizontal components 34 of the tracks 28, 30 hold the door 10 when it is in the raised position. It can be appreciated from FIG. 1 that in this position the door 10 is essentially parallel the vehicle floor 36.

Figure 2:
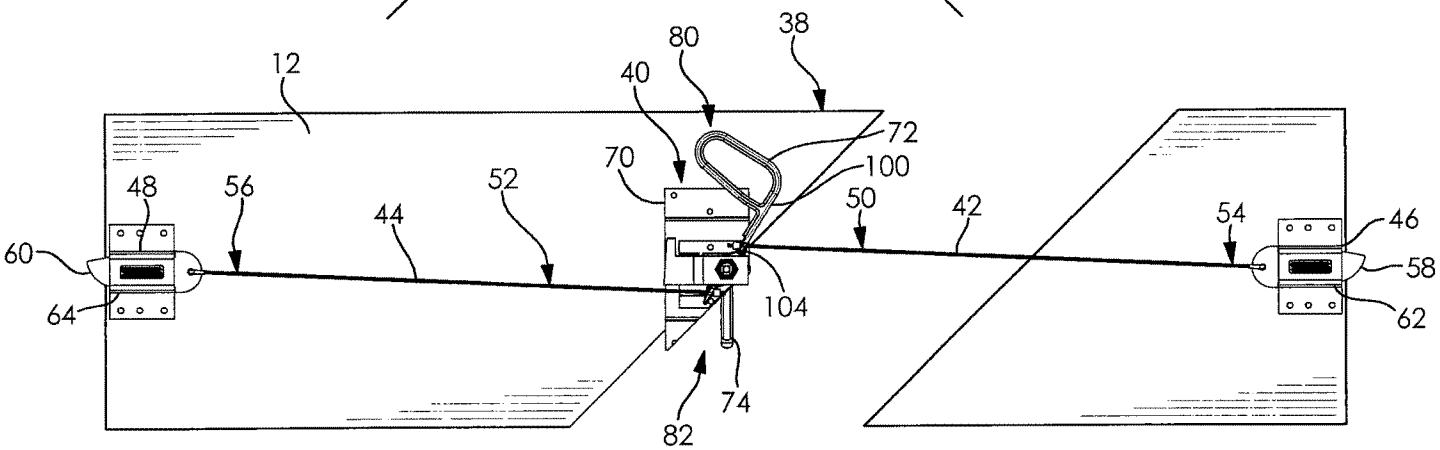
FIG. 2 is a close up view from the inside of the vehicle of a handle system installed on the rolling door of FIG. 1 with an inside handle in a first position and an exterior handle in a first position.

Turning now to FIG. 2, one embodiment of a handle system 38 for the door 10 is depicted. The system 38 comprises a handle mechanism 40, a first cable 42, a second cable 44, a first latch 46 and a second latch 48. Inboard ends 50, 52 of the first cable 42 and the second cable 44 are attached to the handle mechanism 40. Outboard ends 54, 56 of the first cable 42 and the second cable 44 are connected to first and second locking pins 58, 60.

In one position, the cables 42, 44 may be such as braided steel cables. The cables 42, 44 should have sufficient tensile strength to repeatedly pull and move the locking pins 58, 60 as described below.

The locking pins 58, 60 are housed within first and second pin housings 62, 64 as part of the first and second latches 46, 48. The locking pins 58, 60 may selectively slide within the pin housings 62, 64.

The locking pins 58, 60 preferably extend axially beyond the pin housings 62, 64. The locking pins 58, 60 selectively extend into first and second pin catches 66, 68 mounted to or in the tracks 28, 30, as shown in FIG. 1C. When the locking pins 58, 60 are in the pin catches 66, 68, the door 10 is locked and it cannot be raised. FIG. 2 depicts the locking pins 58, 60 in their extended position. The locking pins 58, 60 may be spring biased to the extended position.

Figure 4:
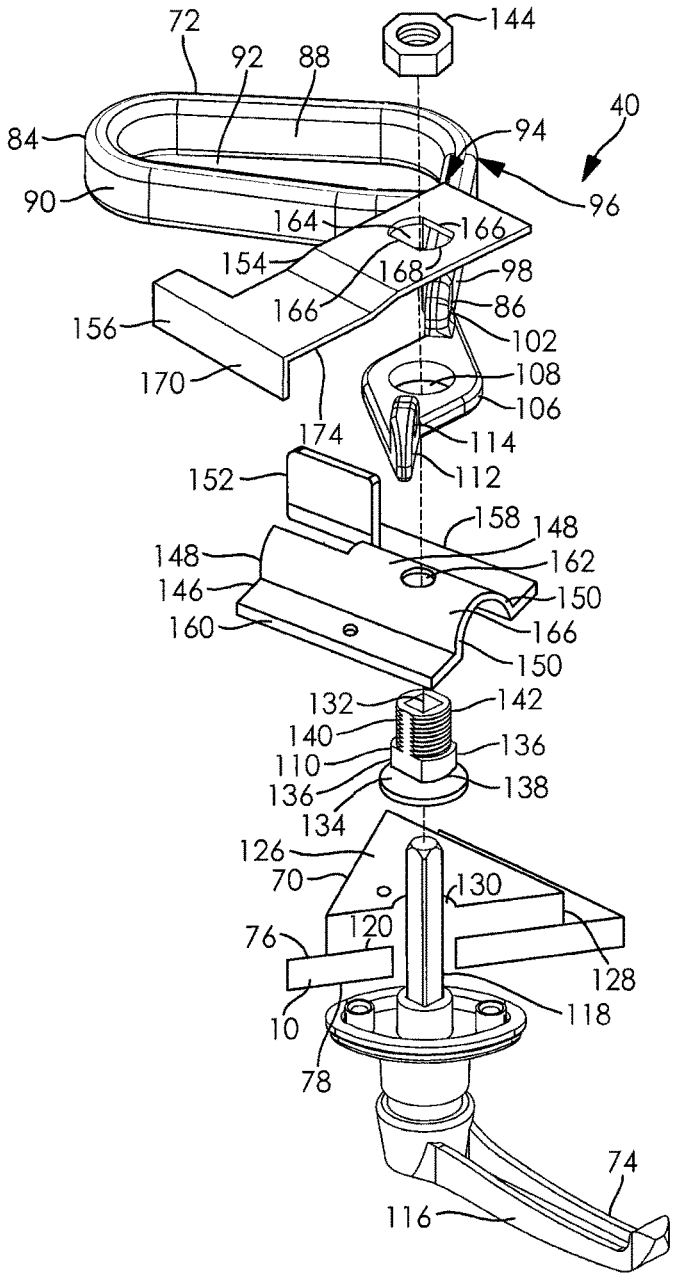
FIG. 4 is an exploded view of the handle mechanism with the inside handle in the first position and the exterior handle in a second position.

As seen in FIGS. 2 and 4, the handle mechanism 40 is mounted to a mounting plate 70. The mounting plate 70 is a metal bracket that can be selectively attached to the door 10 with mechanical fasteners.

As shown in FIGS. 2 and 4, the handle mechanism 40 comprises an inside handle 72 and an outside handle 74. The inside handle 72 is located on an inside side 76 of the door 10 and the outside handle 74 is located on an outside side 78 of the door 10.

In FIG. 2, the inside handle 72 is in a first position 80 and the outside handle 74 is in a first position 82. From FIG. 2 it can be appreciated that the two handles 72, 74 are not co-planar with one another in the respective first positions 80, 82. Instead, the two handles 72, 74 are located at an angle with respect to one another.

Turning to FIG. 4, an exploded view of the handle mechanism 40 is provided. The handle system 38 comprises the inside handle 72. The inside handle 72 comprises a hand portion 84 and a shank portion 86. The hand portion 84 and the shank portion 86 are unitary, one-piece and integrally formed of a metal material, such steel or aluminum or alloys thereof.

The hand portion 84 has a generally tapered oval shape. More particularly, the hand portion 84 tapers downwardly from the shank portion 86. The hand portion 84 has an inner surface 88 and an outer surface 90 which define between them a substantially constant thickness. The inner surface 88 defines an opening 92, or loop, in the hand portion 84 designed to receive the hand of an operator. More particularly, the opening 92 is large enough to receive 3 or 4 fingers of an adult's hand.

The shank portion 86 extends from a corner 94 of the hand portion 84. The shank portion 86 may extend in the same plane as an end portion 96 of the oval shape of the hand portion 84. Further, a wall 98 of the shank portion 86 has the same orientation as the end portion 96 of the handle portion 84.

As seen in FIGS. 2 and 4, a first end portion 100 of the shank portion 86 is attached to the end portion 96, or the corner 94, of the hand portion 84. A second end portion 102 is located opposite the first end portion 100. An aperture 104 extends through the second end portion 102 and receives one of the cables 42.

A mounting stud receiving plate 106 is integrally formed, unitary and one-piece with the second end portion 102. The mounting stud receiving plate 106 is oriented transverse to the second end portion 102. An aperture 108 is located in the plate 106 for receiving a mounting stud 110, described in more detail below.

Opposite the connection of the plate 106 to the second end portion 102, the plate 106 is attached to a cable eye 112. The cable eye 112 is oriented transverse to the plate 106, but coplanar with the shank portion 86. An aperture 114 is located in the cable eye 112 for receiving one of the cables 44. The second end portion 102 and the cable eye 112 are aligned in the same plane.

FIG. 4 also depicts the outside handle 74. The outside handle 74 comprises a single bar 116 that can be gripped by the operator outside of the vehicle. The bar 116 is oriented transverse to a handle stud 118. The handle stud 118 extends through a door panel 12. The handle stud 118 and the door panel 12 are oriented transversely with respect to one another.

The mounting plate 70 is located on an inside surface 120 of the panel 12. The mounting plate 70 has parallel upper 122 and lower edges 124. The edges 122, 124 are oriented parallel with the door panel intersections 16.

The mounting plate 70 is comprised of at least one mounting portion 126. The mounting portion 126 is raised off of the inside surface 120 of the panel 12 by a L-shaped flange 128. The mounting portion 126 is preferably planar. An aperture 130 is provided through the plate 70 so that the handle stud 118 can extend therethrough. The handle stud 118 has a substantially square cross-section.

The mounting stud 110 is located on the handle stud 118. The mounting stud 110 has a hollow interior 132 with an inner cross-section complementary to the cross-section of the handle stud 118. The mounting stud 110 is designed to be located on the handle stud 118, and move with it, with there being no relative motion between the two in the installed condition.

The mounting stud has two exterior surface areas. An inner exterior surface 134 has two parallel flats 136. The flats 136 are located approximately 180 degrees from one another and are separated by curvilinear surfaces 138. An outer exterior surface 140 has threads 142 for mating with a threaded nut 144. The inner exterior surface 134 directly abuts the outer exterior surface 140.

A stop plate 146 is mounted to the mounting portion 126 of the mounting plate 70 such as with mechanical fasteners to prevent relative rotation of the two plates 70, 146. The stop plate 146 is comprised of at least one L-shaped flange and a planar sliding surface 148. Preferably, there are two L-shaped flanges 150 bounding the planar sliding surface 148. The L-shaped flanges 150 raise the planar sliding surface 148 from the mounting portion 126 so that a gap is located between them.

One of the flanges 150 has a tab 152 located thereon. The tab 152 is oriented transverse to the planar sliding surface 148. The tab 152 acts as a stop to a top edge 154 of a swing plate 156, which is described below.

The stop plate 146 has parallel upper and lower edges 158, 160. The edges 158, 160 are oriented parallel with the door panel intersections 16.

The planar sliding surface 148 has an aperture 162 extending therethrough. The aperture 162 receives the handle stud 118 therethrough.

The handle stud 118 also extends through an aperture 164 in the swing plate 156. The aperture 162 has a complementary shape to the inner exterior surface 134 of the mounting stud 110, which is located on the handle stud 118. Namely, the aperture 162 has two parallel surfaces 166 connected by two curvilinear surfaces 168. The parallel surfaces 166 are opposite one another. The mounting stud 110 is thus designed to move with the swing plate 156, and thus the outside handle 74, by virtue of the complementary shape of the aperture 164 and the mounting stud 110 shape. The swing plate 156 is generally rectangularly shaped. A flange 170 extends off an end of the plate 156. The swing plate has parallel upper and lower edges 154, 174. Based on the above, it is clear that the mounting stud receiving plate aperture 108, the swing plate mounting stud aperture 164 and the stop plate aperture 162 are aligned. Further, based on the described arrangement, it can be appreciated that one side of the mounting stud receiving plate 106 is in direct contact with the swing plate 156 and an opposite side of the mounting stud receiving plate 106 is in direct contact with the stop plate 146. In addition, it can be appreciated that the handle mechanism 40 comprises the mounting plate 70, the inside handle 72, the outside handle 74, the stop plate 146 and the swing plate 156.

Figure 3:
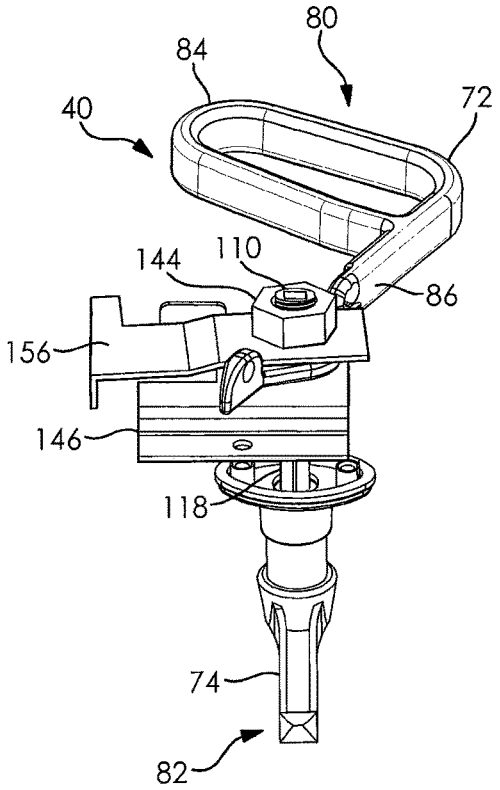
FIG. 3 is a perspective view of a handle mechanism of the system from FIG. 2 with the inside handle in the first position and the exterior handle in the first position.

Turning now to FIGS. 2 and 3, the inside handle 72 is depicted in a first position 176. In this case, the first position 176 represents the handle system 10 in a locked condition. More particularly, the locking pins 58, 60 are extended beyond the pin housings 62 64 to be located in the pin catches 66, 68 to lock the door 10 in the down position. The inside handle 72, comprising the hand portion 84 and the shank portion 86, are angled at approximately a 2 o'clock position. The swing plate 156 has its upper and lower edges 154, 174 parallel to the upper and lower edges 122, 124, 158, 160 of the mounting plate 70 and the stop plate 146. The outside handle 74 is non-coplanar with the inside handle 72 when the inside handle 72 is in the first position. Namely, it is oriented at approximately a 6 o'clock position.

Figure 5:
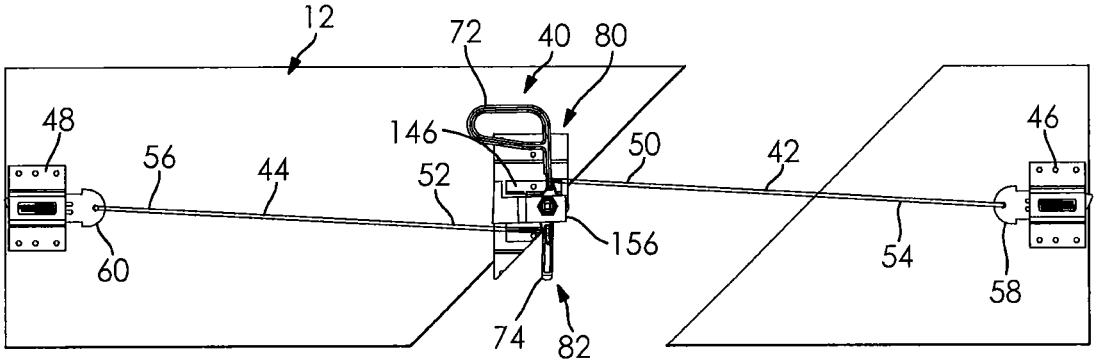
FIG. 5 is a view from inside the vehicle of the handle system with the inside handle in a second position and the exterior handle in the first position.
Figure 6:
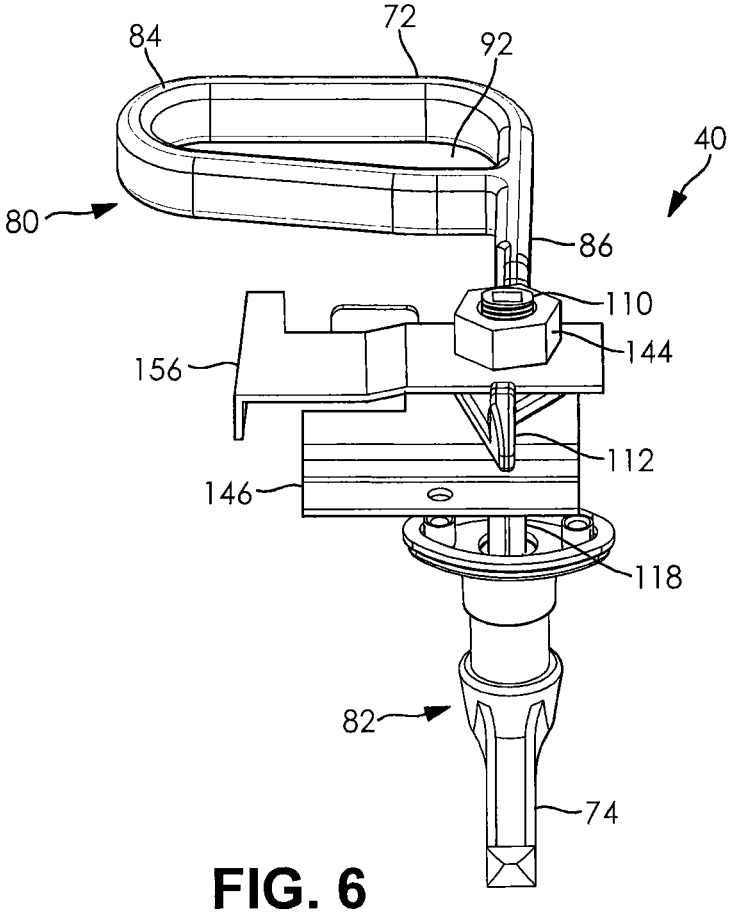
FIG. 6 is a perspective view of the handle mechanism with the inside handle in the second position and the exterior handle in the first position.

Turning now to FIGS. 5 and 6, the inside handle 72 is depicted in a second position 178. In the second position 178, the inside handle 72 has been rotated counterclockwise from the first position 176. The inside handle 72 is angled at approximately a 12 o'clock position. The outside handle 74 is still in a first position 180.

It can be appreciated from FIG. 5 that the rotation of the inside handle 72 has pulled the cables 42, 44 toward the handle mechanism 40. As a result, the cables 42, 44 pulled the locking pins 58, 60 so they slid within the pin housings 62, 64. The locking pins 58, 60 are no longer engaged with the pin catches 66, 68.

The inside handle 72 is now in a fully upright, 12 o'clock position thus making it easily accessible. In other words, the shank portion 86 is oriented substantially horizontally thus orienting the handle portion 84 in a substantially horizontal orientation. In addition, the inside handle 72 is now oriented in the direction of travel of the roll-up door 10. Thus, the handle 72 can be grasped and pulled upon directly upward to raise the roll-up door 10. This has significant mechanical advantages as well as ergonomic advantages for the operator. In addition, the inside handle 72 provides a substantial gripping surface allowing the operator to insert one or both hands into the handle loop 92 and to pull upwardly on the handle 72. The handle 72, being of robust metallic construction, and mechanically attached to the door 10, provides a sturdy, convenient, and secure structure to raise the door 10.

Figure 7:
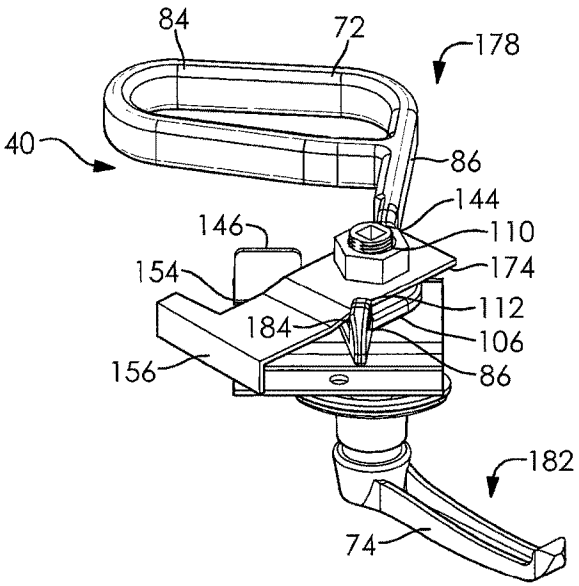
FIG. 7 is a perspective view of the handle mechanism with the inside handle in the second position and the exterior handle in the second position.
Figure 8:
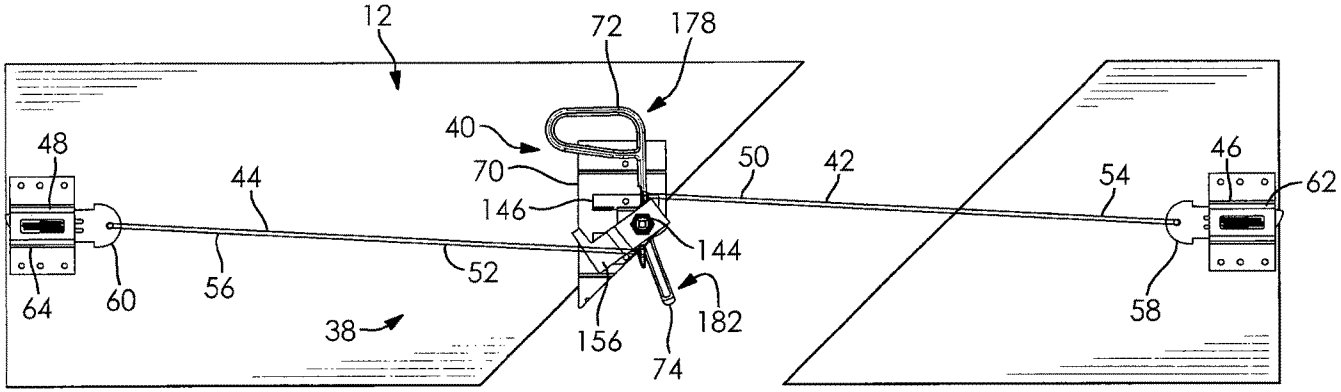
FIG. 8 is a view from inside the vehicle of the handle system with the inside handle in a second position and the exterior handle in the second position.

Turning now to FIGS. 7 and 8, the inside handle 72 is in the second position 178, but the outside handle 74 has been rotated in a counterclockwise direction (as seen in the figures) to a second position 182. The rotation of the outside handle 74 has caused the swing plate 156 to move from its original position depicted in the previous figures, to a new position. Namely, it has rotated in a counterclockwise direction so that its upper and lower edges 154, 174 are no longer parallel with the intersections 16 of the door panels 12. As can be appreciated in FIGS. 7 and 8, the lower edge 174 of the swing plate 156 is now in contact with the shank portion 86 of the inside handle 72. More particularly, the lower edge 174 of the swing plate 156 is now in contact with the cable eye 112 of the inside handle 72. The swing plate 156 is engaged at an intersection 184 of the cable eye 112 with the mounting stud receiving plate 106.

The engagement causes the entire inside handle 72 to rotate from the first position 176 to the second position 178, which in turn draws the cables 42, 44 inwardly toward the handle mechanism 40, which in turn pulls the locking pins 58,60 through the pin housings 62, 64 and out of the pin catches 66, 68, thus unlocking the door 10. The door 10 may now be raised from the outside by grasping the outside handle 74 and pulling up.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed is:

1. A handle mechanism for operating latches on a vehicle rolling door, comprising:

a selectively rotatable inside handle having a tapered oval handle portion and a shank portion unitarily formed with the handle portion, wherein the shank portion defines a shank end portion with a first cable aperture operatively connected to a first latch, a mounting stud receiving plate attached to the shank end portion and provided with a plate aperture and a cable eye attached to the mounting stud receiving plate and provided with a second cable aperture operatively connected to a second latch;

an outside handle having a handle stud operatively connecting an outside handle to an inside handle;

a selectively rotatable swing plate having a mounting stud aperture, said aperture defined by two parallel straight sides and two curvilinear sides, said swing plate having an upper edge and a lower edge, wherein said swing plate selectively contacts said mounting stud receiving plate between the end shank portion and the cable eye;

a stationary stop plate having a handle stud aperture, the stop plate having a tab to selectively contact said upper edge of said swing plate when said swing plate is selectively rotated by operation of either said outside handle or said inside handle; and a mounting stud located over said handle stud to secure the handle stud, wherein the mounting stud has a first outer surface with two flats separated by curvilinear surfaces and a second threaded outer surface, wherein the mounting stud extends through said plate aperture and said mounting stud aperture so as to threadably secure a fastener to said second threaded outer surface to lock said mounting stud to said swing plate.

2. The handle mechanism for operating latches on a vehicle rolling door of claim 1, wherein said mounting stud has an inside surface with a complementary shape to an outside surface of said handle stud to lock the mounting stud to the handle stud.

3. The handle mechanism for operating latches on a vehicle rolling door of claim 1, wherein said shank portion extends from a corner of the handle portion.

4. The handle mechanism for operating latches on a vehicle rolling door of claim 1, wherein said first cable aperture and said cable eye are aligned in a same plane and said mounting stud receiving plate is transverse to said plane.

5. The handle mechanism for operating latches on a vehicle rolling door of claim 1, wherein said mounting stud flats are complementary to said swing plate mounting stud aperture two parallel straight sides and said mounting stud curvilinear surfaces are complementary to said two curvilinear sides of said swing plate mounting stud aperture.

6. The handle mechanism for operating latches on a vehicle rolling door of claim 1, wherein a first cable is located through said first cable aperture and a second cable is located through said cable eye, wherein said cables are attached to said shank portion.

7. The handle mechanism for operating latches on a vehicle rolling door of claim 1, wherein said mounting stud receiving plate has an aperture that is aligned with said swing plate mounting stud aperture, and said stop plate aperture.

8. The handle mechanism for operating latches on a vehicle rolling door of claim 1, wherein said handle stud extends through a vehicle rolling door panel and a mounting plate, said mounting plate spaced from said vehicle rolling door panel so that there is a gap between them.

9. The handle mechanism for operating latches on a vehicle rolling door of claim 2, wherein said mounting stud inside surface has a square cross section and said handle stud has a square cross section outside surface.

10. The handle mechanism for operating latches on a vehicle rolling door of claim 1, wherein said mounting stud is unitary, one-piece and integrally formed and said first outer surface abuts said second threaded outer surface.

11. The handle mechanism for operating latches on a vehicle rolling door of claim 1, wherein one side of said mounting stud receiving plate is in direct contact with said swing plate and an opposite side of said mounting stud receiving plate is in direct contact with said stop plate.

12. A system for operating latches on a vehicle rolling door, comprising:

a selectively rotatable inside handle having a handle portion and a shank portion, wherein the shank portion defines a shank end portion with has a first cable aperture operatively connected to a first latch, a mounting stud receiving plate attached to the shank end portion and provided with a plate aperture and a cable eye attached to the mounting stud receiving plate and provided with a second cable aperture operatively connected to a second latch;

an outside handle having a handle study operatively connecting an outside handle and an inside handle;

a selectively rotatable swing plate having a mounting stud aperture, said aperture having two parallel straight sides and two curvilinear sides, said swing plate having an upper edge and a lower edge, wherein said swing plate selectively contacts said mounting stud receiving plate between the end shank portion and the cable eye;

a stationary stop plate having a handle stud aperture, the stop plate having a tab to selectively contact said upper edge of said swing plate when said swing plate is selectively rotated by operation of either said inside handle or said outside handle;

a mounting stud located over said handle stud secure the handle stud, wherein the mounting stud has a first outer surface with two flats separated by curvilinear surfaces and a second threaded outer surface, wherein the mounting stud extends through said plate aperture and said mounting stud aperture so as to threadably secure a fastener to said second threaded outer surface to lock said mounting stud to said swing plate;

a first end of a first cable attached to said shank portion through said first cable aperture, and a second end of said second cable attached to a first locking pin; and a first end of a second cable attached to said shank portion through said cable eye and a second end of said second cable attached to a second locking pin.

* * * * *